United States Patent [19]

Derrick et al.

[11] Patent Number: 5,032,227

[45] Date of Patent: Jul. 16, 1991

[54] PRODUCTION OF PAPER OR PAPERBOARD

[75] Inventors: Arthur P. Derrick, Cronulla, Australia; William Hatton, Atlanta, Ga.

[73] Assignee: Vinings Industries Inc., Atlanta, Ga.

[21] Appl. No.: 547,485

[22] Filed: Jul. 3, 1990

[51] Int. Cl.[5] ..... D21H 17/34

[52] U.S. Cl. ..... 162/168.1; 162/168.3; 162/181.6; 162/181.8; 162/183

[58] Field of Search ..... 162/168.1, 168.2, 168.3, 162/181.6, 181.8, 183, 164.1, 164.5

[56] References Cited

U.S. PATENT DOCUMENTS 4,305,781 12/1981 Langley et al. ..... 162/181.8
4,445,970 5/1984 Post et al. ..... 162/168.3
4,749,444 6/1988 Lorz et al. ..... 162/183
4,753,710 6/1988 Langley et al. ..... 162/181.8

*Primary Examiner*—Peter Chin
*Attorney, Agent, or Firm*—Kane, Dalsimer, Kane, Sullivan, Kurucz, Levy, Eisel and Richard

[57] ABSTRACT

The fines retention or drainage properties of mechanical pulps in the paper making process are improved by including in the thin stock, not after the last point of high shear, particles of a water-dispersible colloid siliceous material such as a bentonite clay in intimate association with a low molecular weight water soluble high anionic charge density polymer, such as polyacrylic acid having a molecular weight below 50,000 and a charge density of at least 4 m eq/g and further including in the thin stock, after the last point of high shear, a non-ionic high molecular weight polyelectrolyte such as polyacrylamide having a molecular weight of at least 100,000.

10 Claims, No Drawings

PRODUCTION OF PAPER OR PAPERBOARD

BACKGROUND OF THE INVENTION

1. Field of the Invention

This invention relates to the production of paper or paperboard and more particularly to a process for improving the retention and/or drainage properties of paper or paperboard stocks during sheet formation.

2. Brief Description of the Prior Art

Pulps which are used for papermaking fall into the two main categories of chemical and mechanical with intervening categories which can be referred to as semi-chemical and chemimechanical. In the chemical pulps lignin is dissolved out of the wood structure to a greater or lesser degree with the result that the wood fibres may be separated without recourse to any substantial mechanical processing. An example of a chemical pulping process is the Kraft process in which the chips of wood are digested with a strongly basic solution of sodium sulphide. In semichemical pulping processes chemical digestion is less severe and some degree of mechanical processing is necessary to achieve separation of the fibres. In chemimechanical pulping processes the chemical digestion part of the process is still less severe. A marked characteristic of chemical pulps is that the cellulosic fibres largely escape fragmentation and are relatively long.

SUMMARY OF THE INVENTION

The present invention relates to the use in papermaking of pulps which have been produced by mechanical processes. In these processes the separation of the wood fibres is achieved wholly, or substantially wholly, by mechanical attrition and as a result the pulps contain a substantial proportion of fragmented fibres or fibre bundles. Examples of mechanical pulping processes are the groundwood, refiner mechanical pulping (RMP) and thermomechanical pulping (TMP) processes. In the groundwood process bolts of wood are pressed against rotating silicon carbide or alumina "stones" which act to wear the wood away. In the RMP process chips of wood are fed between parallel rotating plates moving in a counter-rotating manner and as they move outwardly between the plates are progressively reduced by arrays of progressively finer breaker bars on the plates. In the TMP process the chips of wood are first subjected to steaming which somewhat reduces the effect of fibre fragmentation in the succeeding mechanical processing stage. There will however still be present in TMP pulps a substantial proportion of fibre fragments.

DETAILED DESCRIPTION OF THE INVENTION

In the manufacture of paper or paperboard it is common practice to use a mixture of different types of pulps which are selected in view of the type of paper or paperboard product required and for many types of product to add to the pulp additives, such as pigments for example titanium dioxide, fillers, for example kaolinite or calcium or magnesium carbonate or sizing agents, for example rosin compounds or synthetic organic sizing agents.

The paper forming process involves the draining of stock through a fabric or metal screen or "wire" on which the paper sheet is formed. It is desirable for the draining time to be as short as possible and for loss of additives and/or fibre in the drainage water to be minimised i.e. the retention properties of the stock should be maximised. There have been many attempts to improve these somewhat conflicting properties by means of additives or combinations of additives such as combinations of organic or inorganic polyelectrolytes or combinations of such polyelectrolytes with colloidal swelling clays, colloidal silica or other colloidal materials.

Such attempts have met with some degree of success in relation to chemical stocks, or mixtures containing a substantial proportion of chemical stock but there are particular problems associated with improving the retention or drainage properties of mechanical stocks in which lignin components as well as most of the other non-cellulose components are still present and carry through to the headbox systems. Such papermaking stocks after refining are typified by a high content of well dispersed fines (less than 75 micron) and are extremely difficult to destabilize and flocculate using aluminium salts or traditional high molecular weight cationic, anionic, or nonionic flocculants. To illustrate the different reactivities of stocks to the action of a high molecular weight medium charge density cationic flocculant and the relative lack of amenability of high TMP stocks to usual flocculation methods the following fines retention measurements were made at 0.6% consistency.

The stocks were

A. Newsprint stock—U.S. Southeast

B. Newsprint stock—U.S. Southeast

C. High TMP Stock—U.S. Southeast

Commonly used newsprint stocks such as stocks A and B contain typically 15–20% wt. semi-bleached Kraft fibre in addition to TMP fibre. The high TMP Stock contained 4% wt semi-bleached Kraft and 96% wt TMP fibre. The cationic flocculant was a typical high molecular weight, medium charge density flocculant, of composition acrylamide 60%, dimethylamino ethyl methacylate methyl chloride quaternary 40% on a weight basis.

| % wt polymer flocculant on furnish solids | Fines % wt Retention | | |
|---|---|---|---|
| | Stock A | Stock B | Stock C |
| Nil | 42 | 13 | 7 |
| 0.01 | 71 | 19 | |
| 0.015 | 74 | | |
| 0.02 | 76 | 26 | |
| 0.03 | 82 | 33 | |
| 0.05 | | | 11 |
| 0.10 | | | 13 |
| 0.20 | | | 21 |

Dual component polymer systems i.e. the combination of a high molecular weight cationic polymer followed by a high molecular weight anionic polymer, the use of low molecular weight cationic donors etc. do not have any significant activity on these difficult to process high TMP stocks. One process, known as the Net Bond process of Boliden Kemi AB countered these adverse characteristics by making use of the ability of an aliphatic polyether such as a high molecular weight polyethylene oxide to form an association complex with linear water soluble phenol formaldehyde resins. This combination treatment allows a "co-precipitation" bridging mechanism to take place resulting in "flocculation" of the pulp suspension. The practical application of this process to a paper machine significantly improves first pass retention and encourages drainage and dewatering on both the wire and the felts.

U.S. Pat. No. 4,305,781 relates to the improvement of the drainage properties of unfilled stocks having a cationic demand of at least 0.1% by the addition of a bentonite and of a high molecular weight substantially non-ionic polymer. The stocks envisaged are predominantly of the thermomechanical type and that specifically described contains, besides mechanical pulps, 25% of chemical sulphate pulp. On this commonly used type of newsprint stock an improvement in drainage and retention properties is shown.

U.S. Pat. No. 4,749,444 relates to a process for the production of paper which exhibits good formation and surface quality in which process a swelling bentonite is added to thick stock having a consistency of from 2.5 to 5% by weight, the stock consistency is then brought to 0.3 to 2% by weight by dilution in water, a high charge density cationic polyelectrolyte (molecular weight at least 50,000, charge density not less than 4 meq/g) is added and, after thorough mixing, a high molecular weight polyacrylamide or polymethacrylamide, or a copolymer of either of these with anionic or cationic monomers, is added. It is noteworthy that data contained in this specification shows that, in relation to a TMP pulp, the drainage and retention properties obtained when bentonite is used alone, or when bentonite and a high molecular weight polyacrylamide homopolymer are used in combination, are poor and substantially identical contrary to the teaching of U.S. Pat. No. 4,305,781.

The present invention provides a process for the production of paper or paperboard from a mechanical stock comprising including in the thin stock in the papermaking process, not after the last point of high shear in the process, a particulate water-dispersible colloidal siliceous material the particles of which are in intimate association with a low molecular weight water-soluble high anionic charge density polymer and further including in the thin stock, after the last point of high shear in the process a substantially nonionic high molecular weight polyelectrolyte.

The process of the present invention can give retention and/or drainage properties in mechanical stocks which can equal or surpass those obtained by previous processes or by the use of a combination of a swelling bentonite clay in its usual sodium form with a high molecular weight substantially nonionic polyelectrolyte. The process results in efficient and robust flocculation.

In order to define the scope of the present invention in relation to paper stocks certain terms are defined as follows. Mechanical stock is used to refer to a stock containing not more than 20% and preferably less than 15% by weight of chemical, chemimechanical or semimechanical pulp. Thin stock is taken to have a consistency less than 1.5% wt.

The particulate siliceous material envisaged according to the invention comprises layered or three dimensional materials based on SiO4 tetrahedra the layered materials being optionally interlayered with other materials such as alumina and/or magnesia octahedra. Layered materials particularly useful in the practice of this invention are the smectite family of clay minerals which are three-layer minerals containing a central layer of alumina or magnesia octahedra sandwiched between two layers of silica tetrahedra and have an idealised formula based on that of pyrophillite which has been modified by the replacement of some of the Al+3, Si+4, or Mg+2 cations by cations of lower valency to give an overall anionic lattice charge. The smectite group of minerals includes the montmorillonites which term includes the bentonite, beidellite, nontronite, saponite and hectorite minerals. Such minerals preferably have a cation exchange capacity of from 80 to 150 m.eq/100g dry mineral. For use according to the present invention the smectite minerals are preferably in the sodium or lithium form, which may occur naturally, but is more frequently obtained by cation exchange of naturally occuring alkaline earth clays, or in the hydrogen form which is obtainable by mineral acid treatment of alkali metal or alkaline earth metal clays. Such sodium, lithium or hydrogen-form clays generally have the property of increasing their basal spacing when hydrated to give the phenomenon known as swelling and are colloidally dispersed relatively easily. While swelling clays of natural origin are mainly envisaged synthetic analogues thereof are not excluded such as the synthetic hectorite material available from Laporte Industries under the trade name Laponite.

In relation to the above siliceous materials the term colloidal is used to indicate the ability to disperse, or be dispersed, in an aqueous medium to give a colloidal dispersion. Compositions according to the invention need not be in the dispersed state and may, for example, be in a solid particulate form which may be dispersed into the colloidal state at or near the point of use. The size of colloidally dispersible particles is generally in the range $5\times10-7$ cm to $250\times10-7$ cm.

The substantially non-ionic high molecular weight polyelectrolyte which is added to the thin stock after the last point of high shear according to the invention is preferably a polyacrylamide or polymethacrylamide homopolymer suitably having a weight average molecular weight in excess of 100,000 but preferably from about 500,000 to 20 million. The homopolymer may alternatively be modified by a content of up to 15% but preferably up to 10% on a molar basis of charged monomer units which content may be obtained by copolymerisation methods. While the charged monomer units may be cationic in nature for example amino acrylates or other monomers as described in U.S. Pat. No. 4,749,444 Column 4 lines 41–64 they are preferably anionic in nature. One method for producing an anionic monomer content in a polyacrylamide polymer may be attained by partial hydrolysis of the amide content thereof. Alternatively it may be attained by copolymerisation with acidic monomers such as acrylic acid or other C3–C5 carboxylic acids. The acidic groups may be present as the corresponding salt, suitably the sodium salt.

The level of addition of the non-ionic polyelectrolyte to the thin stock is suitably from 0.0025 to 0.5% but preferably from 0.01% to 0.1% by weight based on the solids content of the thin stock.

The low molecular weight water-soluble high charge density polymer which is in intimate association with the colloidal siliceous material according to this invention have some or all of the following characteristics which contribute to their effectiveness.

(a) they are substantially linear, that is they contain no cross-linking chains or sufficiently few not to inhibit water-solubility, (b) they are either homopolymers of charged units or are copolymers containing more than 50%, preferably more than 75% and particularly preferably more than 85% of charged units, (c) they are of sufficiently low molecular weight to have water solubility. Preferably they have molecular weights below 100,000, but particularly preferably below 50,000 for example, particularly suitably, from 1000 to 10,000, as determined by Intrinsic Viscosity measurements or by Gel Permeation Chromatography techniques. They can preferably form aqueous solutions of at least 20% w/w concentration at ambient temperatures, (d) they have a high charge density, i.e. of at least 4 preferably of at least 7 and up to 24 m.eq/g. Particularly preferably the charge density is at least 8 and, for example up to 18 m.eq/g. The charge densities of anionic polymers may be determined by a modification of the method described by D. Horn in Progress in Colloid and Polymer Science Vol.65, 1978, pages 251–264 in which the polymer is titrated with DADMAC,,which is the cationic polymer polydiallyldimethyl ammonium chloride, to excess and then back-titrated with polyvinyl sulphonic acid.

Such high charge density polymers are not flocculants and would not normally be considered for use in paper-making processes.

Examples of anionic high charge density water-soluble polymers suitable for use herein are polyacrylic acid
polymethacrylic acid
polymaleic acid
polyvinyl sulphonic acid
polyhydroxy carboxylic acids
polyaldehyde carboxylic acids
alkyl acrylate/acrylic acid copolymers
acrylamide/acrylic acid copolymers and salts, for example alkali metal or ammonium salts of any of the above.

The intimate association between the colloidal siliceous particles and the high charge density polymer which is required according to the present invention may be achieved by a variety of methods. One such method is dry mixing to provide a product which may be transported readily and dispersed in water on site. Alternatively, a dispersion may be produced by the addition of the colloidal siliceous particles to water containing the high charge density polymer. A concentrated dispersion of the modified colloidal siliceous particles according to this invention may be formed by the above methods for ready dilution for addition to paper stock, or may even be added directly to paper stock. Such concentrated dispersions may suitably but not essentially contain a surfactant and preservative and have a concentration based on the dry weight of the siliceous material of at least 50 g/litre but up to the maximum concentration which is pumpable and preferably above 100 g/l and up to for example 250 g/l. Such dispersions may suitably be diluted to from about 5 g/l to 25 g/l for addition to the stock. An alternative method of carrying out the invention is to add the colloidal siliceous material and the water-soluble high charge density polymer species successively, in either order of preference, directly to the stock or to a portion of the stock which has been withdrawn temporarily from the process. Successive addition implies that there should preferably be no significant shear, significant stock dilution, e.g. by more than about 20%, or addition of flocculant, between the addition of the siliceous particles and the high charge density polymers. This is not a preferred embodiment of the invention since the large volume of water present may delay or prevent, to an extent, the association of those species.

It has been found that the colloidal siliceous particles and the water soluble high charge density polymer interact to form composite colloidal species even though the high charge density polymer is anionic and the colloidal siliceous particles are swelling clay particles based on an anionic lattice by virtue of substitutions in the octahedral layers. The nature of the interaction is not known but may be due to hydrogen bonding involving hydroxyl ions on the clay lattice. The examination of the composite colloidal particles according to the invention by electrophoretic techniques, for example as described below, shows that the siliceous particles and the polymer molecules exist as a single entity in aqueous dispersion and move only as a single species through the electrophoretic cell and, further, that the ionicity of the siliceous particles has been modified by that of the polymer as shown by an alteration in the velocity of the composite particles from that of unmodified particles of the siliceous material.

In the following tests for electrophoretic mobility particles were timed for 5 graticule spacings. The timing distance over 5 graticules was 0.25 mm. The electrode data was:

| | |
|---|---|
| Applied Potential (V) = | 90 V |
| Interelectrode Distance (I) = | 75 mm |
| Applied Field (E) = | 1250 VM-1 |

The samples to be tested were prepared as follows. A sodium-form swelling montmorillonite known by the trade name FULGEL 100 was washed and dried and samples were slurried at a concentration of 1 g/l in demineralised water and, separately, in 0.01 molar sodium chloride solution each at the natural pH of 9.8 and 9.6 respectively. The sodium chloride addition was to simulate the ionic content of a paper stock. Additionally, a similar slurry in 0.01 molar sodium chloride but adjusted with ammonium chloride to a pH of 7.0 to simulate conditions in a neutral paper stock was prepared. The procedure was repeated using the same clay which had been modified by reaction according to the invention with an anionic water soluble polymer comprising a neutralised polyacrylic acid having a charge density of 13.7m.eq./g and a molecular weight of 2500 at a loading of 10% by weight of the clay.

The electrophoretic mobilities of these six samples, in every instance towards the positive electrode, was as follows (units$\times 10-8=M2S-1V-1$).

| | Clay | Clay/anionic polymer | % increase |
|---|---|---|---|
| pH 9.8 Demin. water | 3.67 | 5.10 | 39 |
| 9.6 NaCl | 2.52 | 3.59 | 56 |
| pH 7 NaCl | 2.30 | 3.84 | 67 |

Thus, in the case of an anionic swelling clay and an anionic polymer, for example, the natural lattice charge may be increased by, for example, up to about 70%, the amount of the increase being determinable by the charge density of the polymer and the quantity of polymer, but being preferably at least 10%, particularly preferably at least 20%. Similarly, it is envisaged that a charge could be given to a siliceous material having a nett nil change such as silica.

Preferably the anionic high charge density polymer is used in from 0.5% to 25% on the dry weight of the siliceous material, particularly preferably from 2% to 10% on the same basis. The level of addition of the polymer/siliceous material complex to the thin stock may be that usual in the art for swelling clays for example from 0.01% to 2.5% preferably 0.05 to 0.5% based on the weight of the solids already present in the stock.

In putting the present invention into practice it is important that the siliceous material/anionic polymer be mixed into the thin stock. This may be accomplished by adding this material before the last point of high shear in the process. Points of high shear in the process are, for example, pumping, cleaning, or mixing equipment such as the fan pump. The term "high shear" is used to contrast with shear levels resulting from mere flow of the stock through the process. The substantially non-ionic high molecular weight polyelectrolyte may be added after the last point of high shear, very suitably less than 20 seconds upstream of the head-box.

The present invention will now be illustrated by means of the following examples.

In the following Examples the effect of the practice of the invention on the retention and drainage properties of different stocks is compared to the polyethylene oxide/phenol formaldehyde Net Bond process at a typically used dosage rate of 0.01% wt polyethylene oxide and 0.072% wt phenol formaldehyde resin based on the weight of the furnish solids and at twice that dosage (0.02% wt and 0.144% wt respectively). It may be seen that the invention can give a considerable improvement on the standard process in respect of retention although in respect of drainage time some degree of disimpovement may sometimes be seen.

In each case, unless otherwise stated, the stock comprised greater than 90% wt TMP and less than 10% semi-bleached Kraft. Various samples of stock differ in respect of consistency % and fines fraction % as indicated.

The retention tests were conducted using standardised Britt Jar procedures. A standard volume of stock of known consistency and fines fraction was introduced into the Britt Jar apparatus and bentonite swelling clay which had been pre-loaded with 10% by weight of the clay of polyacrylic acid having a molecular weight of 5000 and an anionic charge density of 13 m.eq./g was added as a 10 g/l concentration dispersion. The stock was then stirred for 30 seconds at the indicated speed. Thereafter the indicated quantity of a high molecular weight substantially non-ionic polymer was added and mixed by jar inversion. When the typical dosage or twice typical dosage Net Bond process was used the phenol formaldehyde resin was introduced into the same volume of the stock and mixed in vigorously for 3 seconds after which the polyethylene oxide solution was added. The treated stock sample was then transferred to the Britt Jar, mixed in for 30 seconds at the indicated speed and the treated stock was then drained over 30 seconds at the same speed. In all tests the drained sample was weighed and filtered and then dried at 110° C. to constant weight.

The high molecular weight substantially non-ionic polymer was either a 100% non-ionic polyacrylamide (Polymer A) or a slightly anionic copolymer thereof containing 95% polyacrylamide and 5% sodium acrylate (Polymer B) or was replaced by a strongly cationic polymer (Polymer C) for comparative purposes.

The drainage tests were conducted using Canadian Standard Freeness equipment to determine the drainage time of 200 ml of stock, either untreated, treated according to the Net Bond process or treated according to the invention, using a Britt Jar for mixing (750 rpm) all as above described.

Examples 4–7, 10, 11, 12(a) to 16(a), 20 to 24, 27 and 28 are according to the invention the remaining Examples being comparative.

EXAMPLES 1–7

| | | | | |
|---|---|---|---|---|
| | Stock Consistency | | 0.57% | |
| | Fines Fraction | | 67% | |
| | Britt rpm (retention tests) | | 1500 | |
| Ex No. | Additive(s) | % on solids | % Retention | Drainage (secs) |
| 1 | — | — | 34 | 22 |
| 2 | Net Bond | 0.01%/0.072% | 37 | 40 |
| 3 | Net Bond | 0.02%/0.144% | 40 | |
| 4 | Anionic mod. clay/Polymer B | 0.2%/0.02% | 39 | |
| 5 | Anionic mod. clay/Polymer B | 0.2%/0.03% | 58 | |
| 6 | Anionic mod. clay/Polymer B | 0.2%/0.04% | | 20 |
| 7 | Anionic mod. clay/Polymer B | 0.2%/0.05% | 65 | |
| | Examples 8–11 | | | |
| | Stock Consistency | | 0.48% | |
| | Fines Fraction | | 66% | |

In these tests the Britt Jar was at 750 rpm for 15 seconds followed by a 45 second drain time

| Ex No. | Additive(s) | % on solids | % Retention |
|---|---|---|---|
| 8 | — | — | 15 |
| 9 | Net Bond | 0.02%/0.144% | 40 |
| 10 | Anionic mod. clay/ Polymer B | 0.2%/0.05% | 74 |
| 11 | Anionic mod. clay/ Polymer A | 0.2%/0.05% | 53 |

EXAMPLES 12–16

In these tests the process has been performed on five different stocks containing varying levels of TMP (86–96%). The Britt Jar was run at 750 or 1000 rpm for 15 seconds before draining and the doses were optimized on each stock.

The optimized doses of chemicals varied from 0.15 to 0.30% for the Bentonite or anionically modified Bentonite and from 0.02 to 0.05% for Polymer B.

Although the optimized chemical doses vary from one stock to another they are comparable on each sample where identical conditions and doses were used.

| | % RETENTION EXAMPLE NUMBER | | | | |
|---|---|---|---|---|---|
| | 12 | 13 | 14 | 15 | 16 |
| (a) Control | 13 | 15 | 10 | 15 | 15 |
| (b) Bentonite/Polymer B | 29 | 62 | 45 | 69 | 28 |
| (c) Anionically Modified Bentonite/ Polymer B | 31 | 64 | 51 | 74 | 34 |

-continued

| Examples 17-24 | | | | |
|---|---|---|---|---|
| | Stock Consistency % | | 0.63% | |
| | Fines Fraction % | | 71% | |
| Ex No. | Additive(s) | % on solids | % Retention | Drainage 150 mls (secs) |
| 17 | — | — | 7 | 74 |
| 18 | Polymer A | 0.1% | 14 | |
| 19 | Polymer C | 0.2% | | 92 |
| 20 | Anionic mod. clay/ Polymer A | 0.2%/0.03% | 17 | 70 |
| 21 | Anionic mod. clay/ Polymer A | 0.4%/0.03% | | 69 |
| 22 | Anionic mod. clay/ Polymer B | 0.2%/0.03% | 24 | 79 |
| 23 | Anionic mod. clay/ Polymer B | 0.4%/0.02% | 27 | |
| 24 | Anionic mod. clay/ Polymer B | 0.4%/0.03% | 37 | 73 |

EXAMPLES 25-28

| | Stock Consistency | | 0.57% | |
|---|---|---|---|---|
| | Fines Fraction | | 67% | |
| Ex No. | Additive(s) | % on solids | % Retention | Drainage 150 mls (secs) |
| 25 | — | — | 28 | 122 |
| 26 | Net Bond | 0.01%/0.072% | 37 | |
| 27 | Anionic mod. clay/ Polymer B | 0.1%/0.03% | 60 | |
| 28 | Anionic mod. clay Polymer B | 0.2%/0.04% | 59 | 61 |

We claim:

1. A process for the production of paper or paperboard from a mechanical stock comprising including in the thin stock in the papermaking process, not after the last point of high shear in the process, a particular water-dispersible colloidal siliceous material selected from the group consisting of clay minerals, synthetic analogues thereof and silica, the particles of the colloidal siliceous material being in intimate association with an electrophoretic mobility modifying quantity of a water soluble polymer having a molecular weight below 50,000 and an anionic charge density of from 4 to 24 meq/g and further including in the thin stock, after the last point of high shear in the process a flocculating quantity of a substantially non-ionic polyelectrolyte flocculent having a molecular weight of at least 100,000.

2. A process as claimed in claim 1 wherein the colloidal siliceous material is a clay mineral.

3. A process as claimed in claim 1 wherein the said polymer has a molecular weight below 50,000 and an anionic charge density of from 4 to 24 m eq/g.

4. A process as claimed in claim 3 wherein the said polymer is selected from the group consisting of polyacrylic acid, polymethacrylic acid, copolymers containing said acids, polymaleic acid, polyvinyl sulphonic acid, polyhydroxy carboxylic acids, polyaldehyde carboxylic acids and alkali metal or ammonium salts of any of the aforesaid.

5. A process as claimed in claim 1 wherein the said polymer is used in from 0.5% to 25% based on the dry weight of the siliceous material.

6. A process as claimed in claim 1 wherein the particles of the colloidal siliceous material in intimate association with the said polymer show a modified electrophoretic mobility.

7. A process as claimed in claim 1 wherein the colloidal siliceous material and the said polymer in association therewith are included in the thin stock in from 0.01% to 2.5% in total based on the solids content of the stock.

8. A process as claimed in claim 1 wherein the non-ionic polyelectrolyte is a polyacrylamide having a molecular weight of at least 100,000.

9. A process as claimed in claim 1 wherein the non-ionic polyelectrolyte is included in the thin stock from 0.0025 to 0.5% by weight.

10. A process as claimed in claim 1 wherein the stock comprises at least 80% mechanical fibres.

* * * * *